United States Patent [19]

Harris et al.

[11] Patent Number: 4,781,634

[45] Date of Patent: Nov. 1, 1988

[54] WATER DEFLECTOR FOR OUTBOARD MOTOR

[75] Inventors: Cheryl A. Harris, Pickett; James C. Dutcher, Oshkosh, both of Wis.

[73] Assignee: Brunswick Corporation, Skokie, Ill.

[21] Appl. No.: 89,584

[22] Filed: Aug. 26, 1987

[51] Int. Cl.[4] ..... B63H 1/18

[52] U.S. Cl. ..... 440/66

[58] Field of Search ..... 440/66, 71, 113, 900; 114/145 R, 145 A

[56] References Cited

U.S. PATENT DOCUMENTS 4,487,152 12/1984 Larson ..... 440/66

4,657,513 4/1987 Baker ..... 440/66

OTHER PUBLICATIONS

P. 1960, Quicksilver Catalog published by Mercury Marine, a division of Brunswick Corporation.

*Primary Examiner*—Joseph F. Peters, Jr.

*Assistant Examiner*—Jesûs D. Sotelo

*Attorney, Agent, or Firm*—Andrus, Sceales, Starke & Sawall

[57] ABSTRACT

A water deflector or splash guard for diverting water away from the powerhead and bracket assemblies of an outboard motor during operation of a boat. The splash guard is mounted on the bottom of a transom bracket assembly, and includes a flat planar body having a pair of rearwardly extending spaced fins that define a central opening for receiving the lower unit of the outboard motor. The splash guard also includes a pair of downwardly angled tab members extending rearwardly from the body and disposed between the fin members to aid in deflecting water and provide a central recess for accommodating the drive shaft housing and swivel bracket of the outboard motor as well as a notch for accommodating the grounding wire of the motor.

13 Claims, 1 Drawing Sheet

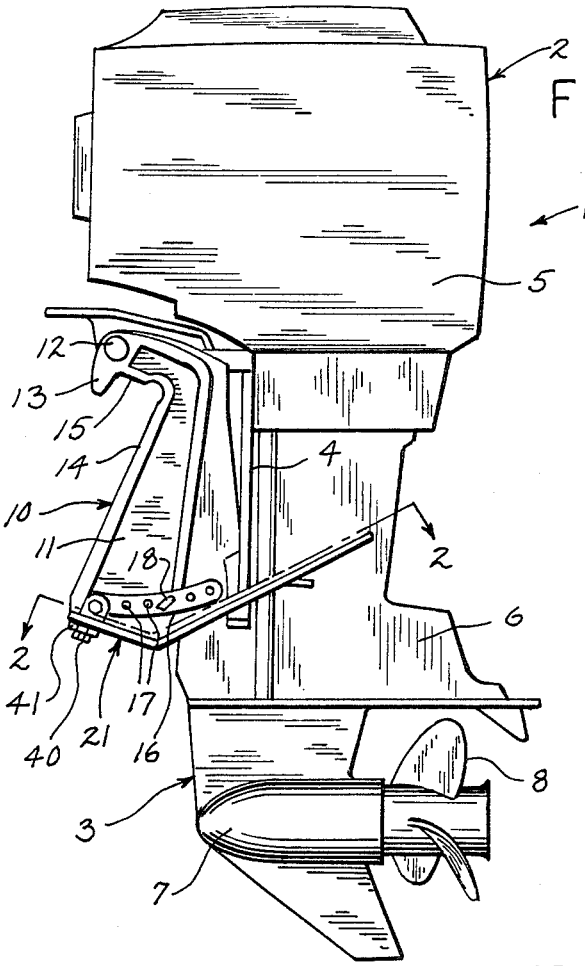
FIG. 1
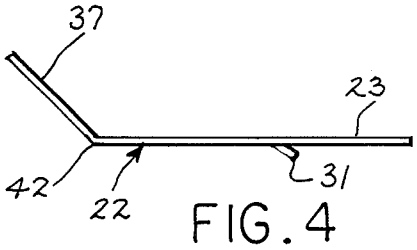
FIG. 4
FIG. 2
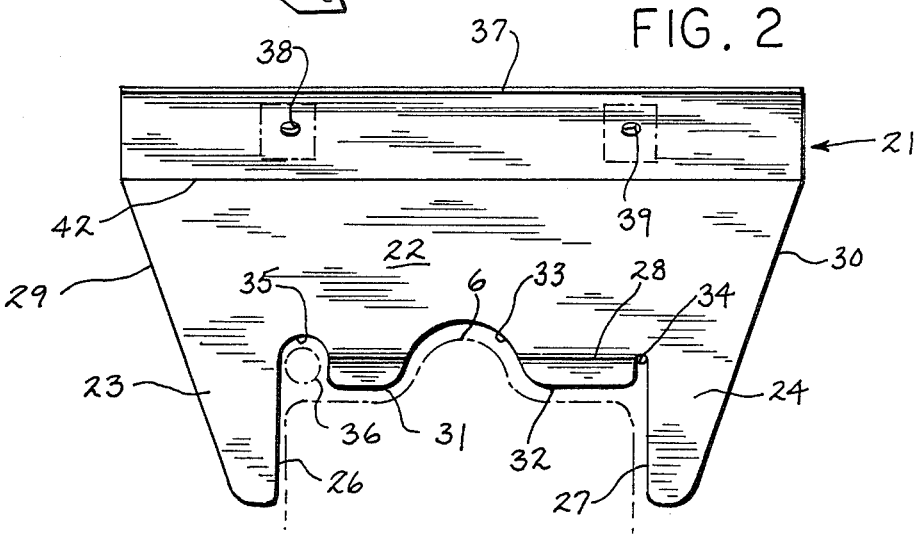
FIG. 3
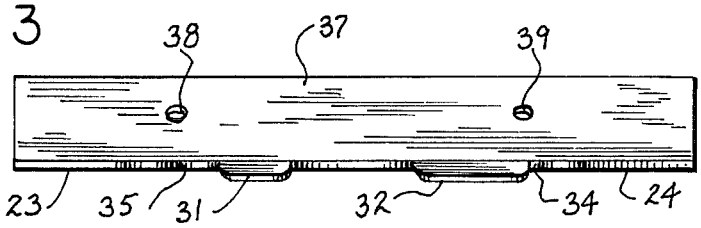

WATER DEFLECTOR FOR OUTBOARD MOTOR

BACKGROUND OF THE INVENTION

The present invention relates to marine propulsion drives, and more particularly to a water deflector or splash guard for an outboard motor.

During operation of some motors, water can on occasion splash, spray and flow onto the engine cowl, trim bracket assembly and motor mounting assembly of the outboard motor and over the transom into the boat. Besides the undesirable effect of water splashing spraying and/or flowing into a boat and onto passengers near the stern of the boat, such water action increases the possibility of corrosion in salt water applications. Such undesirable water action is particularly demonstrated with pontoon boats and conventional boats having deep V or notched hulls since these types of boats tend to demonstrate undesirable water at their stern during forward operation. Additionally, during reverse propulsion, most boats tend to have water flow up onto the transom and the mounting brackets of the motor mounting assembly which again is undesirable due to the possibility of overflowing into the boat as well as the increasing corrosion.

Therefore, it would be desirable to provide a device which would tend to divert water away from the outboard motor, the motor mounting area, and the boat transom. Additionally, it would be desirable to obstruct the flow of water onto the transom and transom brackets during reverse propulsion.

SUMMARY OF THE INVENTION

A water diverter or splash guard for an outboard motor. The splash guard diverts water away from the motor itself as well as away from the boat transom and motor mounting assembly during forward as well as reverse operation of the boat.

The splash guard includes a body member having a pair of rearwardly extending spaced fin members defining a central opening for receiving the outboard motor's lower unit, and mounting means for mounting the body member on the motor mounting assembly. The fin members extend rearwardly beneath the motor mounting assembly to divert and knock down water during boat operation. The central opening between the fin members provides the necessary clearance needed for trimming the outboard motor during operation.

The body member is preferably flat and substantially planar in shape with the fin members integral therewith and disposed adjacent opposite sides of the lower unit of the outboard motor. The splash guard may also include one or more tab members extending rearwardly from the body member disposed between the fin members. The tab members are disposed at an angle with respect to the body member, and are preferably angled rearwardly and downwardly at about 30°. For best results, two spaced apart tab members are utilized which define a central recess for receiving the drive shaft housing of the outboard motor.

The mounting means may include an integral flange member extending laterally across the forward end of the body member. The flange member is preferably angled upwardly and forwardly with respect to the body member at an angle of about 45°. The flange member enables the splash guard to be mounted between the bottom of a transom mounting bracket and a sacrificial zinc anode plate typically mounted to the lower end of the transom mounting bracket.

The present invention thus provides a splash guard which diverts water away from the outboard motor, boat transom and transom mounting area during forward and reverse operation of the boat. The splash guard reduces the splashing, spraying and flowing of water onto the outboard motor, boat transom and motor mounting area. It is especially useful on pontoon boats and conventional boats with deep V or notched hulls since these types of boats tend to demonstrate undesirable water at their stern during forward operation. The splash guard also obstructs the flow of water up onto the engine mounting area during reverse propulsion. Also, by diminishing the quantity of attacking water, the splash guard may be particularly advantageous for reducing corrosion in salt water applications.

Other features and advantages of the invention will become apparent to those skilled in the art upon reviewing the detailed description, the drawings, and the appended claims.

BRIEF DESCRIPTION OF THE DRAWINGS

The drawings illustrate the best mode presently contemplated of carrying out the invention.

In the drawings:

FIG. 1 is a side view in elevation of an outboard motor mounted on a boat transom incorporating a splash guard constructed in accordance with the principles of the present invention;

FIG. 2 is a top plan view of the splash guard taken along the plane of the line 2—2 in FIG. 1;

FIG. 3 is an end view of the splash guard; and

FIG. 4 is a side view in elevation of the splash guard.

DESCRIPTION OF THE PREFERRED EMBODIMENT

Referring now to the drawings, FIG. 1 illustrates a marine propulsion drive in the form of an outboard motor 1 having a propulsion assembly including an upper unit or powerhead 2, a lower unit 3 and a swivel bracket 4. Upper unit 2 includes a cover or cowl 5 defining an engine compartment for housing an internal combustion engine (not shown).

The lower unit 3 is rigidly mounted to the bottom of the powerhead or upper unit 2 and includes a drive shaft housing 6 and a gear case 7. The gear case 7 is normally submerged in water and supports a rotatable propeller shaft carrying a propeller 8. Gear case 7 houses a suitable reversing transmission which drivingly connects propeller 8 to a driveshaft extending through the driveshaft housing 6 which drivingly interconnects the engine and propeller 8.

Lower unit 3 is connected to swivel bracket 4 for swivel or turning movement about a vertical axis and in a horizontal plane to provide steering control of moor 1.

Outboard motor 1 is supported on a transom or other supporting member of a boat hull by a transom bracket 10 on which the swivel bracket 4 is mounted. Outboard motor 1 including swivel bracket 4 is connected to transom bracket 10 for pivotal or tilting movement about a horizontal transverse axis and in a vertical plane between an operating position wherein gear case 7 and propeller 8 are fully submerged in water, and a tilted or non-operating position wherein gear case 7 and propeller 8 are raised from the water, as for trailering.

Tansom bracket 10 includes two spaced-apart inverted U-shaped clamp members or mounting members 11 (only one of which is shown in FIG. 1) for removably mounting outboard motor 1 to a boat transom. Clamp members 11 are interconnected by a pivot pin or tilt shaft 12 which extends substantially horizontally between the upper ends of clamp members 11. Each inverted U-shaped clamp member 11 has an upper body portion with an integral inside leg 13, and outside leg 14 extending downwardly therefrom and defining a transom receiving opening 15 therebetween. Outside leg 14 has an inner bearing surface for bearing engagement against the outside surface of the transom when clamp members 11 are clamped together thereon. Each outside leg 14 also has a rearwardly extending arm 16 thereon with spaced holes 17 therein. A tilt pin 18 is carried through the proper holes 17 to provide an abutment means for swivel bracket 14 resulting in proper trim for motor 1 during operation. A similar arrangment is also present in power trim mounts except that pin 10 is replaced with a selectively moveable lock mechanism. Transom receiving opening 15 may be of any desired width sufficient to enable the engine to be readily installed over transoms of any thickness within a desired range.

A water deflector or splash guard 21 is also illustrated in FIG. 1, and in more detail in FIGS. 2–4, for diverting water away from the powerhead and transom bracket assemblies during forward and reverse operation of the boat. More particularly, splash guard 21 includes a flat, substantially planar body member 22 that extends laterally across transom bracket 10 beneath clamp members 11. As shown best in FIG. 2, body member 22 includes a pair of rearwardly extending spaced fin members 23, 24 defining a central opening for receiving lower unit 3 of motor 1. As shown best in FIGS. 1 and 2, fin members 23, 24 are integral with body member 22 and are disposed adjacent opposite sides of lower unit 3. Fin members 23, 24 include inside edges 26, 27 respectively that are disposed parallel to one another and substantially at right angles with respect to the forward most edge 28 of body member 22 while the outside edges 29, 30 respectively of fin members 23, 24 converge toward one another and are angled rearwardly and inwardly with respect to edge 28.

A pair of spaced apart laterally extending tab members 31, 32 are disposed between fin members 23, 24 which extend rearwardly from body member 22. As shown best in FIGS. 3 and 4, tab members 31, 32 are angled downwardly and rearwardly with respect to body member 22 at an angle of about 30°. This angle functions to aid in diverting water and knocking down spray that might otherwise come off the bottom of clamp members 11, of transom bracket 10 between transom bracket 10 and motor 1. The angle of tab members 31, 32 also aids in permitting motor 1 to be trimmed inwardly as far as possible during operation.

As shown best in FIG. 2, tab members 31, 32 define a central recess 33 therebetween. Central recess 33 is semicircular in shape and accommodates the swivel bracket 4 when motor 1 is in its inwardly trimmed operating position. Sufficient clearance between recess 33 and drive shaft housing 6 is provided to permit proper trimming of motor 1. A notch 34 is also provided between tab member 32 and fin member 24 to permit ease of bending tab member 32 downwardly during fabrication, and another notch 35 is disposed between tab member 31 and inside edge 26 of fin member 23 which is employed to provide clearance for an engine ground wire 36.

As shown best in FIG. 4, splash guard 21 includes a flange member 37 integrally formed along edge 42 of body member 22 and extending laterally across body member 22 and transom bracket 10. Flange member 37 is angled upwardly and forwardly with respect to body member 22 preferably at an angle of about 45°. Flange member 37 also includes a pair of spaced mounting holes 38, 39 for receiving bolts 40 that extend through the flange member 37 into the bottoms of clamp members 11 to mount splash guard 21 between the bottoms of clamp members 11 and a sacrificial zinc anode plate 41 extending beneath members 11. Thus, splash guard 21 may be easily assembled to or removed from transom bracket 10.

A splash guard for an outboard motor has been illustrated and described. Various modifications and/ or substitutions of the specific components described herein may be made without departing from the scope of the present invention. For example, splash guard 21 may be composed of various materials such as metal, or plastic, and the specific dimensions of fin members 23, 24, tab members 31, 32, and body member 22 may be varied depending upon the specific application as may be the angles of flange member 37 and tab members 31, 32. The water deflector of the present invention is equally suitable for use on motors with manual or powered trim systems. Various mounting means may be used to attach the deflector relative to the clamp bracket 10.

Various modes of carrying out the invention are contemplated as being within the scope of the following claims particularly pointing out and distinctly claiming the subject matter which is regarded as the invention.

We claim:

1. In a marine drive having a propulsion assembly including an upper unit housing an engine, a lower unit carrying a propeller and housing a drive shaft for drivingly interconnecting the engine and propeller, and a transom bracket assembly having an upper end and a lower end and positioned forwardly of said propulsion assembly for supporting the propulsion assembly from a transom of a boat for steering, tilting and trimming movement of said propulsion assembly relative to the boat transom, a splash guard for diverting water away from the propulsion and bracket assemblies during operation of the boat, comprising:

a body member having a pair of rearwardly extending spaced fin members defining a central opening for receiving the lower unit of said propulsion assembly; and mounting means for fixedly mounting said body member on the lower end of said transom bracket assembly.

2. The marine drive of claim 1 wherein said body member is substantially planar in shape.

3. The marine drive of claim 1 wherein said fin members are disposed adjacent opposite sides of said lower unit.

4. In a marine drive having a propulsion assembly including an upper unit housing an engine, a lower unit carrying a propeller and housing a drive shaft for drivingly interconnecting the engine and propeller, and a transom bracket assembly positioned forwardly of said propulsion assembly for supporting the propulsion assembly from a transom of a boat for steering, tilting and trimming movement of said propulsion assembly relative to the boat transom, a splash guard for diverting water away from the propulsion and bracket assemblies during operation of the boat, comprising:

a body member having a pair of rearwardly extending spaced fin members defining a central opening for receiving the lower unit of said propulsion assembly;

a tab member extending rearwardly from said body member and disposed between said fin members; and mounting means for mounting said body member on said bracket assembly.

5. The marine drive of claim 4 wherein said body member is substantially planar in shape, and said tab member is disposed at an angle thereto.

6. In a marine drive having a propulsion assembly including an upper unit housing an engine, a lower unit carrying a propeller and housing a drive shaft for drivingly interconnecting the engine and propeller, and a transom bracket assembly positioned forwardly of said propulsion assembly for supporting the propulsion assembly from a transom of a boat for steering, tilting and trimming movement of said propulsion assembly relative to the boat transom, a splash guard for diverting water away from the propulsion and bracket assemblies during operation of the boat, comprising:

a body member having a pair of rearwardly extending spaced fin members defining a central opening for receiving the lower unit of said propulsion assembly;

a pair of spaced tab members extending rearwardly from said body member and disposed between said fin members; and mounting means for mounting said body member on said bracket assembly.

7. The marine drive of claim 6 wherein said body member is substantially planar in shape, and said tab members are disposed at an angle thereto.

8. The marine drive of claim 7 wherein said tab members are angled downwardly.

9. The marine drive of claim 8 wherein said downward angle is about 30°.

10. The marine drive of claim 6 wherein said spaced tab members define a central recess therebetween.

11. In a marine drive having a propulsion assembly including an upper unit housing an engine, a lower unit carrying a propeller and housing a drive shaft for drivingly interconnecting the engine and propeller, and a transom bracket assembly positioned forwardly of said propulsion assembly for supporting the propulsion assembly from a transom of a boat for steering, tilting and trimming movement of said propulsion assembly relative to the boat transom, a splash guard for diverting water away from the propulsion and bracket assemblies during operation of the boat, comprising:

a body member having a pair of rearwardly extending spaced fin members defining a central opening for receiving the lower unit of said propulsion assembly; and mounting means for mounting said body member on said bracket assembly, said mounting means includes a flange member extending laterally across said body member, said flange member is disposed at an angle with respect to said body member, and said flange member is angled upwardly and forwardly.

12. The marine drive of claim 11 wherein said flange member is integral with said body member.

13. The marine drive of claim 11 wherein said upward angle is about 45°.

* * * * *